US008030587B2

(12) United States Patent
Chanteloup

(10) Patent No.: US 8,030,587 B2
(45) Date of Patent: Oct. 4, 2011

(54) ROTARY CONTROL DEVICE FOR MOVING VEHICLE REMOTE CONTROL

(75) Inventor: Thomas Chanteloup, Lyons (FR)

(73) Assignee: Bosch Rexroth D.S.I. (FR)

( * ) Notice: Subject to any disclaimer, the term of this patent is extended or adjusted under 35 U.S.C. 154(b) by 352 days.

(21) Appl. No.: 12/296,443

(22) PCT Filed: Mar. 12, 2007

(86) PCT No.: PCT/FR2007/000429

§ 371 (c)(1),
(2), (4) Date: Feb. 20, 2009

(87) PCT Pub. No.: WO2007/116132

PCT Pub. Date: Oct. 18, 2007

(65) Prior Publication Data

US 2009/0301255 A1 Dec. 10, 2009

(30) Foreign Application Priority Data

Apr. 12, 2006 (FR) ..... 06 03232

(51) Int. Cl.
*H01H 21/24* (2006.01)

(52) U.S. Cl. ..... 200/557

(58) Field of Classification Search ..... 200/557, 200/16 C, 18, 537, 550, 547, 549
See application file for complete search history.

(56) References Cited

U.S. PATENT DOCUMENTS

| | | | | |
|---|---|---|---|---|
| 3,329,785 | A | 7/1967 | Baer et al. | |
| 3,410,971 | A | 11/1968 | Sandor | |
| 5,969,309 | A * | 10/1999 | Nishimura et al. | 200/16 C |
| 2008/0099320 | A1 * | 5/2008 | Kiyono et al. | 200/557 |
| 2008/0099321 | A1 * | 5/2008 | Kiyono et al. | 200/557 |

FOREIGN PATENT DOCUMENTS

| | | |
|---|---|---|
| DE | 871782 | 3/1953 |
| FR | 2823368 | 10/2002 |

OTHER PUBLICATIONS

International Search Report PCT/FR2007/000429; Dated Aug. 30, 2007.

* cited by examiner

*Primary Examiner* — Edwin A. Leon
(74) *Attorney, Agent, or Firm* — Cantor Colburn LLP

(57) ABSTRACT

The invention concerns rotary control device for remote control of a moving vehicle, particularly a civil engineering works vehicle, an agricultural implement or a goods handling vehicle comprising two parts rotatably mobile relative to one another about an axis (A) and formed of a body (2) intended to be fixed to the handle of the remote control and an actuating part (6), the device also comprising first elastic means (13) including a winding (14) and two mobile branches (15, 16), the first actuating part being immobilized, in a position of equilibrium (P), with respect to a first member (2, 6). The device further comprises second elastic means (22) supported, on a mobile branch (15, 16) of the first elastic means (13) and, designed, in the position of equilibrium, to bear against a support portion (24) of the second member (2, 6).

11 Claims, 2 Drawing Sheets

ROTARY CONTROL DEVICE FOR MOVING VEHICLE REMOTE CONTROL

TECHNICAL FIELD OF THE INVENTION

The present invention relates to a rotary control device, designed in particular to be attached to a handle of a moving vehicle remote control, in particular a civil engineering vehicle, agricultural vehicle or materials handling vehicle.

BRIEF SUMMARY OF RELATED ART

A moving vehicle remote control comprises, in a known manner, a handle that can be moved with at least one degree of freedom relative to a support, the movement of this handle allowing an operator to control at least one receiving member external to the remote control.

In order to increase the number of receiving members that are able to be controlled or to make it possible to vary the control instructions, it is a known practice to add to the remote control devices that are able to be controlled by the fingers of the user, and in particular devices of the proportional type.

A first type of device comprises two members, that can be rotated relative to one another about an axis, formed by a body designed to be attached to a handle of the remote control on the one hand, and an actuation portion on the other hand, the device also comprising elastic return means making it possible to return the actuation portion to the vicinity of a position of equilibrium relative to the body from which a user may move the actuation portion in two opposite directions relative to the position of equilibrium.

The elastic means comprise a coil and two movable branches, each movable branch being designed to interact with

- a movement stop arranged on the actuation portion allowing the movement of the movable branch in one direction, and
- a blocking stop arranged on the body designed to serve as a bearing surface on the body when the actuation portion is moved in the opposite direction.

The two movement stops and the two blocking stops form two pairs of stops belonging to two members that can be rotated one relative to the other, the two movable branches being, in the position of equilibrium, in contact with two stops of a first of the two pairs, the elastic means being immobilized relative to a first member.

This type of device makes it possible to provide a simple system of return to the position of equilibrium.

However, there is in this device, in the position of equilibrium, a residual clearance between the second member and the elastic means. This residual clearance causes a free movement of the actuation portion, which is therefore not subjected to the action of the return means over a portion of its travel.

This residual clearance may be reduced by an appropriate dimensioning of the space between the stops of the second member. The precise dimensioning of this space however increases the price of the parts used. In addition, a single coil does not make it possible to obtain a reliable simultaneous contact of the elastic means with the four stops of the two pairs of stops belonging respectively to the two members.

FIGS. 1 and 2 illustrate schematically the relative positioning, in the position of equilibrium, of the body C with two blocking stops B1 and B2, of the actuation portion A with two movement stops B3 and B4 and elastic means E having a single coil and two movable branches.

A residual clearance J1 or J2 appears respectively, according to the configurations, between the actuation portion and the elastic means, or between the body and the elastic means.

To solve this problem, it has been proposed to use a second type of device comprising a double-coil spring with a middle branch connecting the two coils. In the position of equilibrium, each of the two coils is constrained between a stop of the body and a stop of the actuation portion, which makes it possible to completely eliminate the residual clearance.

In particular, document FR2823368 describes such a type of double-coil spring.

This type of device therefore gives satisfaction with respect to the removal of the residual clearance. The structure of the spring, and those of the body and of the actuation portion are however more complex than those explained for the first type of spring.

It is therefore desirable to provide a device making it possible both to remove the residual clearance and also to make it possible to use a simplified structure of the control device.

BRIEF SUMMARY OF THE INVENTION

Accordingly, the present invention relates to a device of the first type described hereinabove, comprising first elastic means corresponding to the elastic means of a device of this first type, and characterized in that the device also comprises second elastic means pressing, in the position of equilibrium, on the one hand on a movable branch of the first elastic means, and on the other hand against a bearing portion of the second member.

Thanks to these arrangements, in the position of equilibrium, the movable branches of the first elastic means are both in contact against the two stops of a first member, and therefore immobilized. The second elastic means, which press on the first elastic means, make it possible, in the position of equilibrium, to apply an elastic force on the second member, applied between a stop of this second member, and a bearing portion of this second member.

The first member and the first elastic means are therefore immobilized relative to one another, the second member is immobilized by the second elastic means, resting on the first elastic means.

The device uses elastic means with a single coil as in the first type of spring described, making it possible to retain a simple spring structure.

Advantageously, the second elastic means have a stiffness that is less than the stiffness of the first elastic means.

The difference in stiffness between the first and second elastic means makes it possible to prevent the stresses applied by the second elastic means from disrupting the positional retention of the first elastic means by the two stops of the first member.

According to one embodiment, the second elastic means comprise an elastic foot connected to a movable branch of the first elastic means.

Advantageously, the elastic foot is connected via an elbow to the end of a movable branch of the first elastic means.

These arrangements make it possible to produce a spring in a single piece and with a simple structure.

According to a first possibility, the bearing portion consists of an additional stop situated on the second member.

According to another possibility, the bearing portion consists of a movement or blocking stop, the second elastic means extending obliquely relative to a plane containing the axis of rotation.

Advantageously, the device comprises an axial stop limiting the translation movement of the coil in the direction of the axis of rotation.

According to one embodiment, the second elastic means are attached to the second member.

Advantageously the second elastic means comprise an elastomer element.

BRIEF DESCRIPTION OF THE DRAWINGS

In any case, the invention will be well understood with the aid of the following description, with reference to the appended schematic drawing, representing, as a nonlimiting example, one embodiment of a device according to the invention.

DETAILED DESCRIPTION OF THE INVENTION

Figure 1:
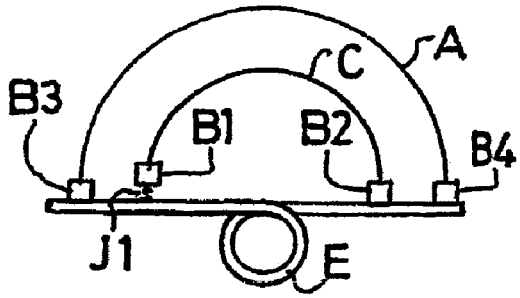
FIG.1 PRIOR ART
FIG. 1 is a schematic view of a first device according to the prior art.
Figure 2:
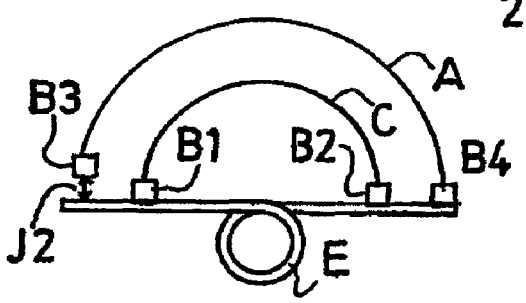
FIG.2 PRIOR ART
FIG. 2 is a schematic view of a second device according to the prior art.

As represented in FIGS. 1 to 4, a rotary control device for a moving vehicle remote control according to the invention comprises, in a known manner, a body 2 designed to be attached to a handle of the remote control, not shown, the body 2 comprising a first portion or base 3 designed to be attached to the handle via its base, which comprises attachment means 4, in particular openings allowing attachment screws to pass through, and a second portion or cover 5, designed to be attached fixedly to the base 3.

The device comprises an actuation portion 6 that can be rotated about an axis A relative to the body 2, comprising in this embodiment:

- a case 7 outside the body 2, designed in particular to be actuated in contact with a finger of a user,
- a pivot 8, movably attached by its ends to the case 7, able to be rotated in a through housing arranged between the base 3 and the cover 4 of the body 2,
- a permanent magnet 9, movably attached to the pivot 8, and contained in the housing between the base 3 and the cover 4.

Detection means, consisting of a Hall effect sensor 10, are attached to the base 3, and detect the movement of the magnet 9 opposite, in order to generate an electric control signal derived from the movement of the actuation portion 6.

The device comprises a spring 12 which includes first elastic return means 13 making it possible to return the actuation portion 6 to a position of equilibrium E from which a user can move the actuation portion in two opposite directions D1, D2 relative to the position of equilibrium E, by contact with the case 7.

The first elastic means 13, of a first stiffness k1, comprise a single coil 14, whose loops surround the axis of rotation A, and two movable branches 15, 16 in the extension of the two ends of the coil 14.

The first movable branch 15 is designed to interact with:

- a first movement stop 17 arranged on the case 7 of the movement portion 6 allowing the movement of the first movable branch 15 in a first direction D1,
- a first blocking stop 19 arranged on the body 2 designed to limit its travel and to serve as a bearing surface on the body when the actuation portion is moved in a second direction D2.

Respectively, the second movable branch 16 is designed to interact with:

- a second movement stop 18 arranged on the case 7 of the movement portion 6 allowing the movement of the second movable branch 16 in the second direction D2.
- a second blocking stop 20 arranged on the body 2 designed to limit its travel and serve as a bearing surface on the body when the actuation portion is moved in the first direction D1.

The spring 12 also comprises second elastic means of a second stiffness k2, less than the first stiffness, consisting of an elastic foot 22 connected via an elbow 23 to the end of the second movable branch 16 of the first elastic means 13. This foot 22 is contained in a plane passing through the axis of rotation A of the actuation portion 6.

The second elastic means rest on the one hand on the second movable branch 16 of the first elastic means, and on the other hand are designed to press against a bearing portion of the actuation portion 6, consisting of an additional stop 24 situated on the actuation portion.

The positioning of the additional stop 24 relative to the second elastic means 22 is such that, during a rotation in the direction D1, the additional stop 24 is in contact with the second elastic means 22 before the second movement stop 18 is in contact with the second movable branch 16.

In the embodiment shown, in the position of equilibrium, the movable branches 15, 16 of the first elastic means 13 are both in contact against the two blocking stops 19, 20 of the body 2, and therefore immobilized. The second elastic means 22, which press on the first elastic means 13, applies an elastic force on the actuation portion 6, applied between:

- the first movement stop 17 on which the first movable branch 15 forming part of the first immobilized elastic means 13 presses, and
- the additional stop 24, on which the elastic foot 22 presses.

The presence of the second elastic means, in the form of an elastic foot, therefore makes it possible to remove the residual clearance.

During a rotation in the first direction D1, the operation is similar to that of a device according to the first known type described above.

During the rotation in the second direction D2, the additional stop 24 is in contact with the end of the elastic foot 22, which bends, particularly thanks to its elasticity k2 which is less than that of the first elastic means 13, then once the elastic foot 22 is bent, the second movement stop 18 comes into contact with the second movable branch 16, substantially at the elbow 23, and moves this second movable branch 16.

As can be seen in the figures, the two movable branches 15, 16 and the stops are placed asymmetrically relative to a plane of symmetry of the actuation portion in the position of equilibrium.

This arrangement makes it possible to use a body of known shape, which has a cylindrical shape only on a limited portion of its upper surface, around which the elastic foot 22 can move in rotation.

The device comprises an axial stop not shown, limiting the translation movement of the coil 14 and of the whole of the spring in the direction of the axis of rotation A of the actuation portion 6.

According to a variant not shown, the bearing portion consists of the extension of the second movement stop, the bearing branch having an oblique profile, relative to a plane passing through the axis of rotation A of the actuation portion 6.

Figure 7:
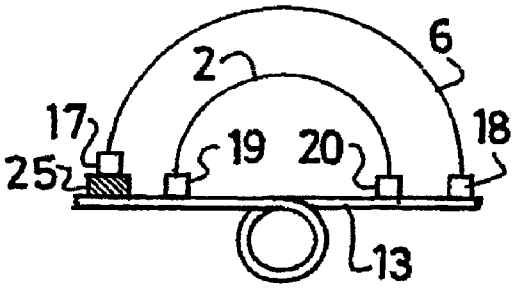
FIG. 7 is a view of a second device according to the invention.
Figure 5:
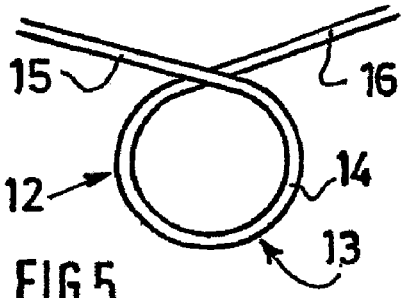
FIG. 5 is a front view of the elastic means of the device of FIG. 1.
Figure 6:
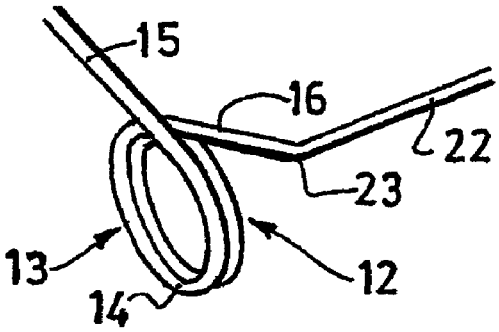
FIG. 6 is a view in perspective of the elastic means of FIG. 3.
Figure 3:
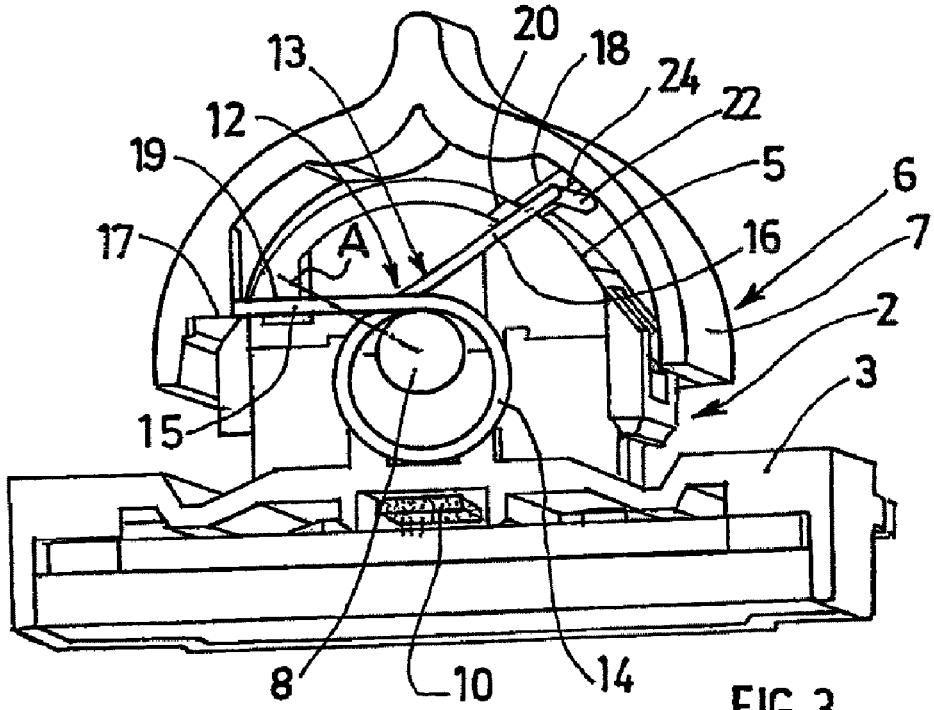
FIG. 3 is a view in perspective of a first device according to the invention, a portion of this device having been cut away.
Figure 4:
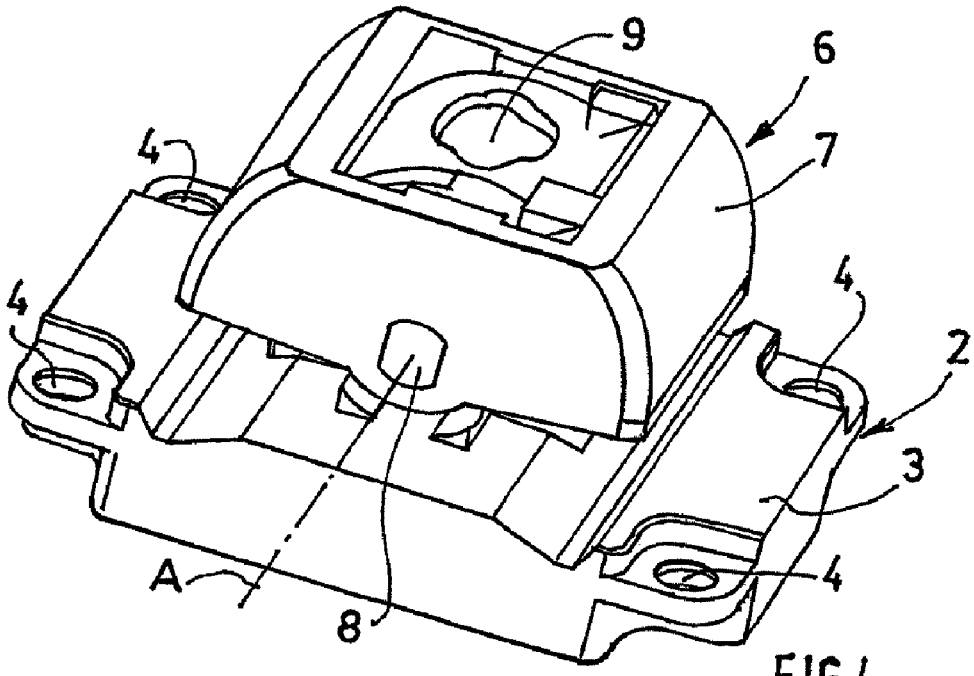
FIG. 4 is a view in section, from the top, of the device of FIG. 1.

According to a second embodiment shown schematically in FIG. 7, it is possible to produce the second elastic means in a manner that is not attached to the first elastic means.

The same elements bear the same reference numbers as in the first embodiment in FIG. 7.

In this second embodiment, the second elastic means may consist of an elastomer element 25, attached to the actuation portion 6, and designed to be, in the position of equilibrium, positioned in compression between a bearing portion of the actuation portion 6 and a movable branch of the first elastic means.

According to variants of the first and second embodiments, it is possible to arrange a space between the movement stops such that the first elastic means are blocked in the position of equilibrium between the two movement stops, then leaving a clearance between the movable branches and the blocking stops. In this case, the second elastic means must press on a bearing portion of the body in order to make it possible to constrain the device in the position of equilibrium.

As it goes without saying, the invention is not limited to the preferred embodiment described above, as a nonlimiting example; on the contrary, it embraces all its variants.

The invention claimed is:

1. A rotary control device for a remote control of a moving vehicle, comprising:

two members, that can be rotated relative to one another about an axis, formed by a body designed to be attached to a remote control handle and an actuation portion;

first elastic return means making it possible to return the actuation portion to a vicinity of a position of equilibrium relative to the body, from which a user may move the actuation portion in two opposite directions relative to the position of equilibrium;

wherein these first elastic means comprises a coil and two movable branches, each movable branch being designed to interact with:

a movement stop arranged on the actuation portion allowing the movement of the movable branch in one direction, and a blocking stop arranged on the body designed to serve as a bearing surface on the body when the actuation portion is moved in the opposite direction;

wherein, the two movement stops and the two blocking stops forming two pairs of stops belonging to the two members that can be rotated relative to one another, the two movable branches being, in the position of equilibrium, in contact with the two stops of a first of the two pairs, the first elastic means being immobilized relative to a first member, wherein the device also comprises second elastic means pressing, in the position of equilibrium, on a movable branch of the first elastic means and against a bearing portion of the second member.

2. The device as claimed in claim 1, wherein the second elastic means have a stiffness that is less than a stiffness of the first elastic means.

3. The device as claimed in claims 1, wherein the second elastic means comprise an elastic foot connected to a movable branch of the first elastic means.

4. The device as claimed in claim 3, wherein the elastic foot is connected via an elbow to an end of a movable branch of the first elastic means.

5. The device as claimed in claim, wherein the bearing portion comprises an additional stop situated on the second member.

6. The device as claimed in claim 1, wherein the bearing portion comprises a movement or blocking stop.

7. The device as claimed in claim 6, wherein the second elastic means extend obliquely relative to a plane containing the axis of rotation.

8. The device as claimed in claim 1, wherein the second elastic means are attached to the second member.

9. The device as claimed in claim 8, wherein the second elastic means comprise an elastomer element.

10. The device as claimed in claim 1, which further comprising an axial stop limiting translation movement of the coil in a direction of the axis of rotation.

11. The device as claimed in claim 3, wherein the second elastic means extend obliquely relative to a plane containing the axis of rotation.

* * * * *